United States Patent [19]

Bennett

[11] 4,119,482

[45] Oct. 10, 1978

[54] APPARATUS FOR SELECTIVELY PRINTING AND APPLYING LABELS TO ARTICLES OF DIFFERENT SIZES AND SHAPES

[75] Inventor: William F. Bennett, Cypress, Calif.

[73] Assignee: Marketing Information Systems Incorporated, Long Beach, Calif.

[21] Appl. No.: 734,088

[22] Filed: Oct. 20, 1976

[51] Int. Cl.[2] ..... B65C 9/28; B65C 9/42

[52] U.S. Cl. ..... 156/351; 156/362; 156/363; 156/384

[58] Field of Search ..... 156/277, 384, 351, 358, 156/362, 363, 497, 540, 541, 542, 584, DIG. 25, DIG. 27, DIG. 28, DIG. 31, DIG. 33, DIG. 38, 350, 521, 566

[56] References Cited

U.S. PATENT DOCUMENTS

| | | | |
|---|---|---|---|
| 3,140,214 | 7/1964 | Von Hufe | 156/351 |
| 3,367,822 | 2/1968 | Hoffler | 156/363 |
| 3,594,257 | 7/1971 | Von Hofe | 156/361 |
| 3,655,492 | 4/1972 | Burton | 156/384 |
| 3,713,948 | 1/1973 | Kluger | 156/351 |
| 3,938,698 | 2/1976 | McDavid et al. | 156/541 |
| 3,989,583 | 11/1976 | Watson | 156/497 |

FOREIGN PATENT DOCUMENTS

| | | | |
|---|---|---|---|
| 1,927,163 | 8/1970 | Fed. Rep. of Germany | 156/584 |

*Primary Examiner*—Caleb Weston

[57] ABSTRACT

A label printer and applicator including conveyor for continuously moving packages of different sizes and shapes from a loading point to a discharge point. Labels are selectively printed to bear any desired indicia such as pricing information, contents, or quantitites which may be uniquely applicable to any given package moving on the conveyor. Upon arrival of the package at a predetermind point along the conveyor the label, which may be uniquely applicable to that package, is affixed thereto by a novel label applicator.

6 Claims, 10 Drawing Figures

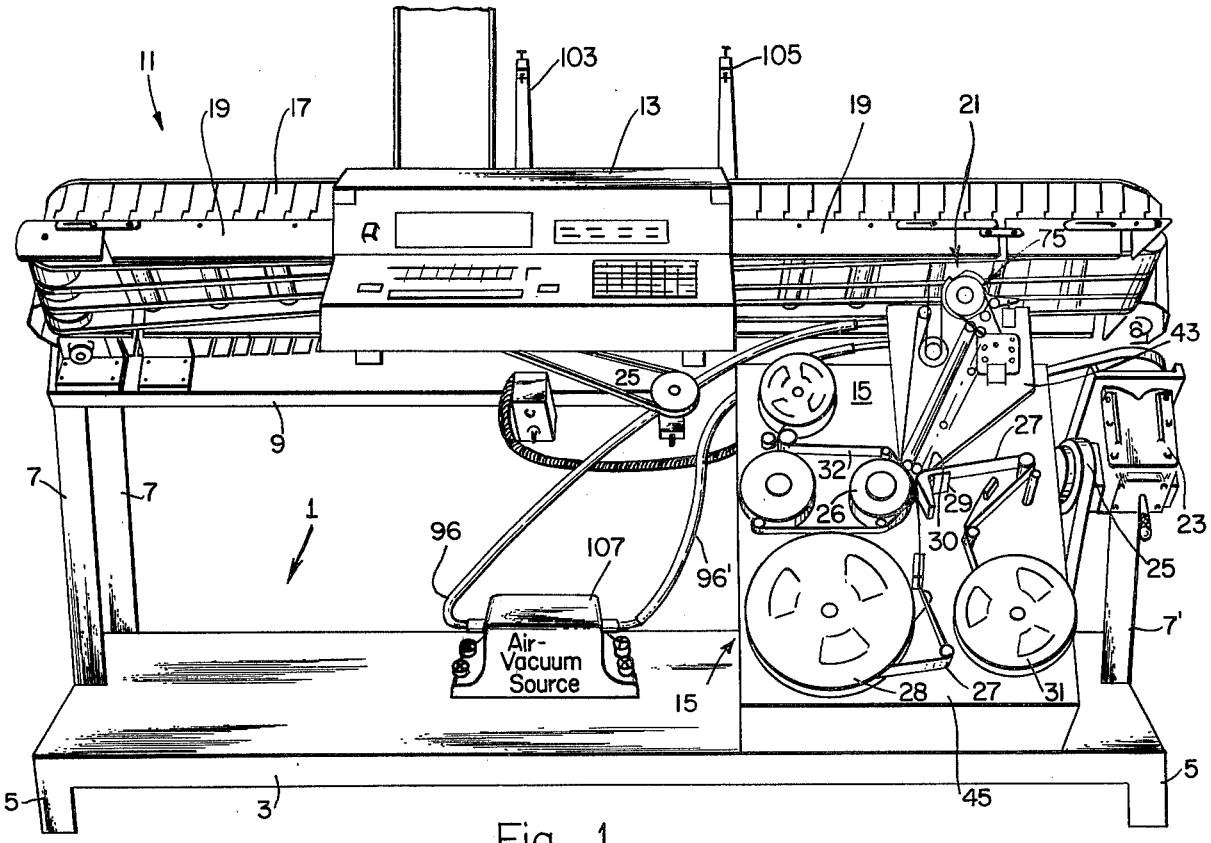
Fig. 1.
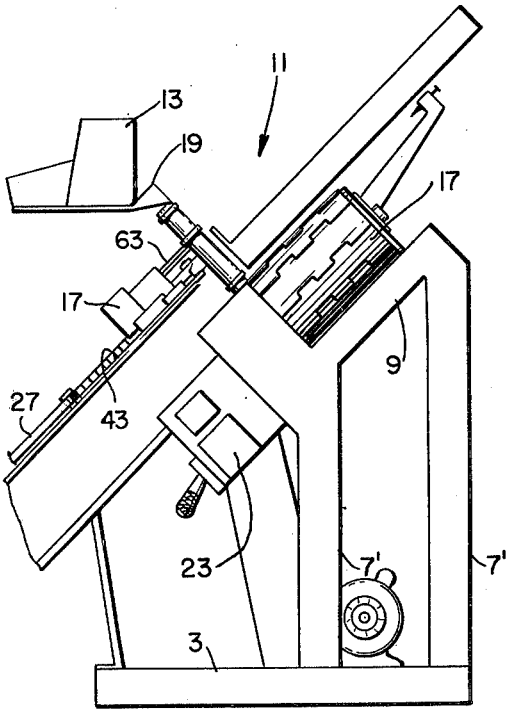
Fig. 2.
Fig. 3.
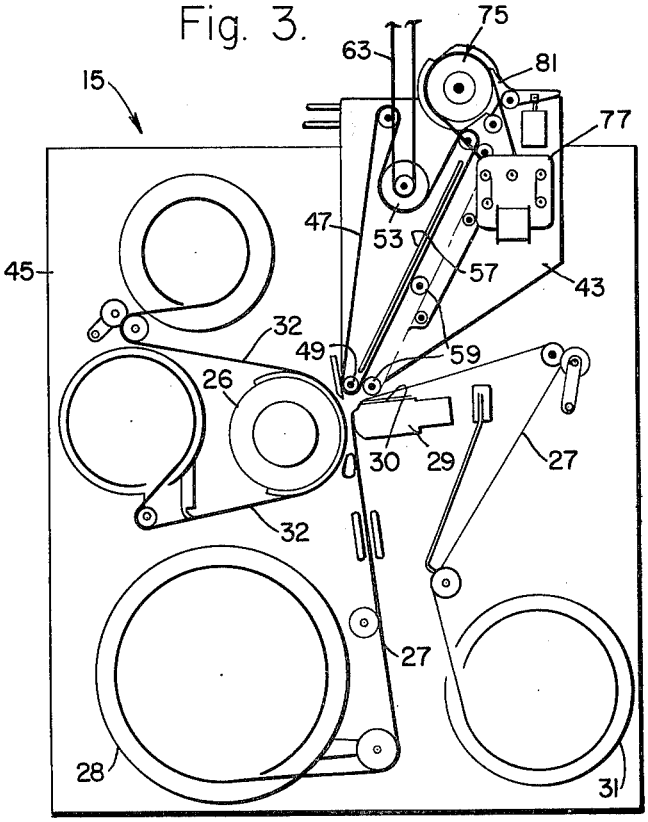

APPARATUS FOR SELECTIVELY PRINTING AND APPLYING LABELS TO ARTICLES OF DIFFERENT SIZES AND SHAPES

BACKGROUND OF THE INVENTION

Labels for bearing various marketing information or other indicia are customarily supplied on a backing strip or tape with the adhesive side of the labels being in contact with the tape and detachable therefrom. When separated from the backing tape the labels must be transported and/or retained with the adhesive side out for application to the desired article or package. The retaining means must be capable of releasing the label at a predetermined time or position. A typical apparatus for carrying out these functions is shown and described in U.S. Pat. No. 3,885,705 wherein a perforated grid for receiving such a label has a plurality of openings through which a vacuum may be "drawn" (or more effective) so as to retain the label. Other openings in this grid are connected to air "blast" tubes so that at the appropriate time relatively high velocity air may be blown there-through to blow the label from the grid into the article. It will be appreciated that in supplying successive labels to successive articles each succeeding article must await the placement of its intended label onto the grid and then moved into position over the grid and label for application of the label to the article. A somwhat similar grid arrangement is also shown and described in U.S. Pat. No. 3,645,832 but with a different arrangement for supplying the label-ejecting air blast thereto. In U.S. Pat. No. 3,655,492 a label-printing and applicating system is shown wherein the labels are held onto a sponge-faced bridge or head by means of vacuum operative through openings in the fixed position bridge and sponge member. The sponge member, being resilient, is able to deform sufficiently to assume a shape conforming to the shape of the package when pressed there against.

It will be appreciated that in all these prior art arrangements the label is transferred to and held by a fixed position head or bridge, the package is then moved into position adjacent to or in contact with the label-retaining head and thereafter the label is applied to the package which must be then removed before this sequence can be recommenced for the next package. Because of this sequential operation such systems are inherently limited in the speed at which labels may be applied to packages by the time required to perform each sequential step.

SUMMARY OF THE INVENTION

The present invention provides improved label applying means which permits packages or articles to be moved rapidly along a conveyor system and receive the proper labels therefore. The labels are retained on the label applicator of the invention by maintaining less than atmospheric air pressure on one side of the label and then applied to the intended article by providing a greater than atmospheric pressure on the aforesaid side to "blow" it onto the article so that the adhesive side of the label contacts and adheres to the package.

With the present invention the applicator rotates from one position where it receives and retains the label, adhesive side out, to a second position at which the label is blown off the applicator into contact with the article. The applicator head of the invention is provided with diametrically opposed perforated portions each of which portions are capable of retaining the label in a first position and then ejecting the label therefrom when the applicator head is rotated to a second position. Hence a label may be delivered to the applicator head for retention thereby while the preceding label is being applied to the article.

The rotatable applicator head of the invention is internally provided with less than atmospheric pressure on the inside of one of the perforated portions in the label-receiving position and to greater than atmospheric pressure again on the inside of this same perforated portion upon rotation of the head to the label applying position. The air pressure, either lesser or greater than atmospheric, is established through the perforations in the head so as to be operative on the label surface on the outside of the perforated portions.

In the label-receiving position of the applicator head the first perforated portion communicates by an internal channel to a source of sub-atmospheric air pressure. When the applicator head is rotated, this perforated portion is brought into communication by a second internal channel with a source of super-atmospheric air pressure. The second perforated portion of the head is likewise alternately brought into communication with the aforementioned differential air sources upon rotation of the head. Rotation of the applicator head is caused by drive means which is actuated in response to the movement of an article or package to or past a predetermined point on the conveyor system.

Thus, as rapidly as packages move along the conveyor system respective labels intended therefore are continuously supplied to the applicator head and applied to the packages.

Another feature of the label-printing and application system of the invention is a label transporter for transferring printed labels from the printing operation to the label applicator. Transporting such labels after they have been removed or stripped from their backing or carrier tape has been troublesome in the past because of the adhesive on the back of the labels which is exposed after stripping. The transporter of the invention provides a series of guide rollers which contact the adhesive-coated backs of the labels but do not adhere to or pick-up the adhesive. These rollers cooperate with a moving belt which contacts the front or printed side of the labels so as to move the labels along between the belt and the rollers.

The invention will be described in greater detail by reference to the following description taken in connection with the accompanying illustrative drawings.

BRIEF DESCRIPTION OF THE DRAWINGS

FIG. 1 is a front elevational view in perspective of an automatic selective label printing and applying apparatus employing the present invention;

FIG. 2 is a right side view of the apparatus shown in FIG. 1;

FIG. 3 is a partially schematic front elevational view of the label printing apparatus employed in conjunction with present invention;

DESCRIPTION

Figure 4:
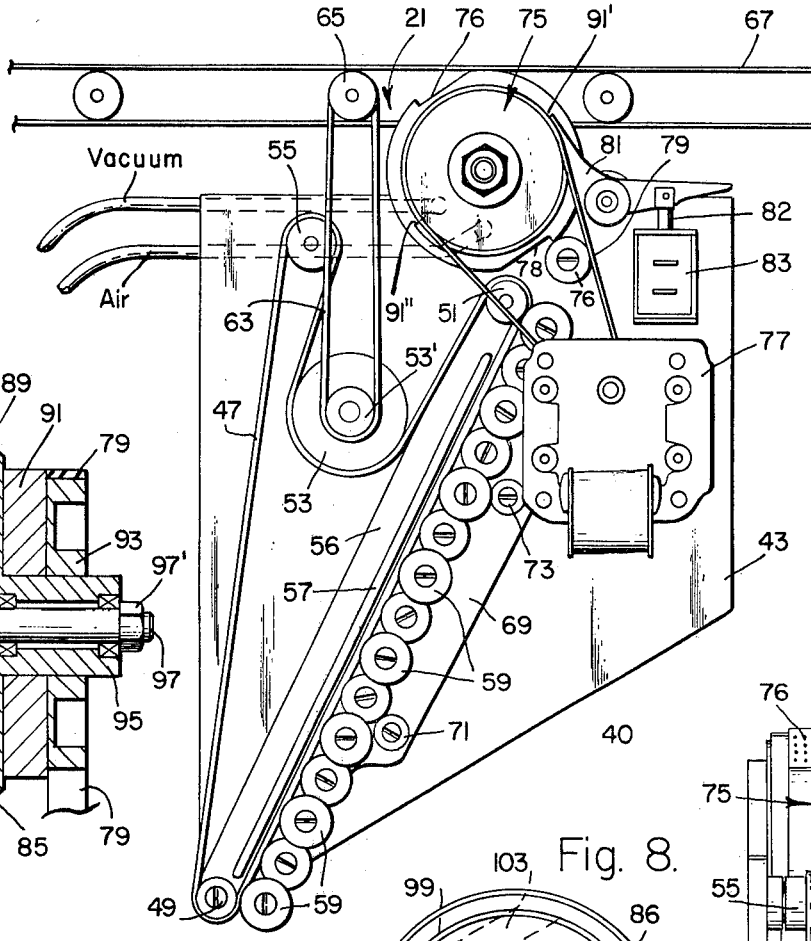
FIG. 4 is a partially schematic front elevational view of the local transport and applicator apparatus of the invention.
Figure 6:
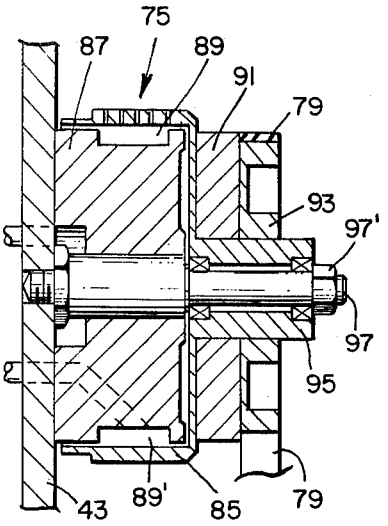
FIG.6 is a sectional view of the applicator assembly of the invention.

FIG. 1 shows a complete label printing and applying system embodying the invention including an article or package feed or supply chute and conveyor means. The parts and components of this system may be assembled and mounted on a basic support or frame structure 1 which comprises a lower horizontally extending shelf member 3 supported on legs 5, 5' and provided with vertical support members 7, 7' on which is mounted an upper horizontally extending frame member 9. The upper horizontally extending frame member 9 may be mounted on the vertical support members 7, 7' at an angle of less than 90° with respect thereto to facilitate the mounting of a V-shaped conveyor system 11 with trough extending downwardly. There may be four vertical support members 7, 7' two each being mounted on each end of the lower shelf member 3, one of each pair being higher than the other to facilitate the angular disposition and mounting of the conveyor 11 as best shown in FIG. 2. Also mounted on the horizontally extending frame member 9 is a printer console 13 including a manual keyboard and control apparatus for selecting the indicia to be printed on labels and for electrically controlling the printing mechanism 15 (which is also shown schematically in FIG. 3). It will be understood that this label printing apparatus is considered as a complete unit which includes the printing mechanism 15, and the keyboard and the electrical control system 13 (console) therefor. Such printers may be of any commerically available type as exemplified by those manufactured and sold by Interface Mechanisms Company of Mountlake Terrace, Wash.

The conveyor system 11 comprises a continuous belt 17 adapted to be driven in one direction such as left to right as viewed in FIG. 1. The belt 17 is disposed at an angle to the horizontal (i.e., 45° ) so that it forms one side of a V-shaped trough which facilitates the transport of articles of various sizes and shapes and presents them properly and in the desired position to receive the label. The other side of the V-shaped trough is formed by a stationary plate member 19 which is co-extensive with the belt 17. The plate member 19 is provided with an opening 21 at a predetermined position therealong through which labels may be applied to the surface of packages of articles as they are carried along by the conveyor belt 17 across this opening. The conveyor belt is driven by an electric motor 23 and pulley system 25 and further description thereof is not provided herein in view of the highly developed and well known state of the art with respect to such conveyor belt drive systems.

Mounted below the conveyor belt system 11 is a printer mechanism 15 which includes a printer drum 26 on which is embossed in relief form a plurality of characters such as alphabetical letters, numerals, and symbols of any desired nature including those capable of forming or printing bar codes.

Adjacent and below the printer drum 26 is a supply reel 28 of pre-cut labels and backing tape 27 the labels being adhesively temporarily secured to the backing tape. The pre-cut labels and backing tape 27 is threaded up between a carbon ribbon 32 which passes around and is backed up by the printer drum 26 and printer hammers 29 with the blank surface of the labels facing the carbon ribbon 32. The labels are thus positioned to be impressed against the carbon ribbon 32 and the embossed characters on the printer drum 26 when the printer hammers 29 strike the back of the pre-cut labels and backing tape 27.

The character or symbol to be printed onto a label is selected by depressing the appropriate key on the console 13 which causes the take-up reel motor 31 to rotate and move the pre-cut labels and backing tape 27 until the selected label is between the carbon ribbon 32 and the printer hammers 29 which are then automatically actuated so as to forcibly drive a label that is between the hammers 29 and the carbon ribbon 32 (backed up by the printer drum 26) into contact with the selected character or symbol embossing on the drum 26 thereon so as to print the character on the label. The pre-cut labels and backing tape 27 move so as to successively position each selected character or symbol embossing at the proper place on the label. It will be understood that the printer drum 26 and the printer hammers 29 move extremely rapidly and are synchronized so that the printer hammers 29 strike the appropriate character embossing when it is properly positioned on the printer drum 26. By employing a printer drum 26 having one or more rows of character embossing labels may be printed having one or more rows of indicia, the rows being printed almost simultaneously.

After the label has been printed with the desired indicia it is then stripped from the backing tape 27 as this tape travels over the edge of stripping shoe 30 and changes its direction of travel by an angle in excess of 75°, for example, in a very small radius turn. As the tape 27 makes this turn it pulls away from the label whose upper end now freely extends upwardly the label being urged by continued travel of the backing tape 27 to move upwardly and enter the transport mechanism 40 for ultimate delivery to label applicator 41 of the invention to be described in greater detail hereinafter. The backing tape 27 minus the labels is then wound up on a take-up reel 31. It will be understood that the backing tape take-up reel 31 is adapted to be rotatably driven as is well known in the art of unwinding tape or film from a supply reel and winding the same up on a take-up reel. It will also be understood that movement of the backing tape 27 and the labels thereon is synchronized with the printer mechanism so that the printing operation does not start until a label is in proper position between the printer drum 26 and the printer hammers 29. Upon completion of the printing operation for each label, the backing tape take-up reel 31 rotates to move the printed label from the print position and place the next label to be printed at this position at which occurence rotation of the backing tape take-up reel 31 ceases.

Referring now to FIG. 4, the label transport system 40 is mounted on a plate member 43 which is adapted and designed to be secured to a base plate 45 which is secured at its lower end to the lower support shelf 3 and at its upper end to the upper horizontally extending support member 9. The plate member 43 is mounted on the base plate 45 as shown in FIG. 3 so that the lower end of the belt and roller wheel assembly of the transport system 40 shown in FIG. 4 is adjacent the point at which labels separate from the backing tape 27 and extend upwardly.

The transport system or assemblage 40 comprises a label transport belt 47 which passes around a first guide roller 49 and then upwardly at angle from the vertical to and around a second grooved guide roller 51. The belt 47 then passes downwardly and around a third roller 53 of larger diameter than that of the guide rollers 49 and 50 and fixedly mounted on its shaft for a purpose to be explained hereinafter. The belt 47 then travels upwardly around a fourth guide roller 55 and downwardly to the first guide roller 49. It will be understood that the label transport belt 47 is fabricated from any suitable material possessing frictional properties such as rubber, for example. This belt 47 may be substantially round in cross-section and of about 3/32 inch in diameter. The guide rollers 49, 51, 53, and 55 are also provided with similar grooves in which the label transport belt 47 travels and is retained in proper position on the guide rollers. The belt 47 and the guide rollers 49 and 51 are positioned and arranged so that the belt 47 will engage substantially only the middle portions of the labels which came into contact with the belt. Peripheral engagement of the labels by the transport belt 47 causes the labels to tip or tilt and results in jamming or erratic operation.

The transport mechanism 40 also includes an elongated flat guide bar member 57 which extends between the guide rollers 49 and 51 and acts as a firm backing and positioning plate for the label transport belt 47 during that portion of belt travel when the belt is engaging and moving the labels from the printer assembly 15 to the label applicator assembly 75 to be described in greater detail hereinafter. Associated with the label transport belt 47 and forming a part of the label transport assembly 40 is a series of label guide and retaining rollers 59 which are positioned along the path of the label transport belt 47 between the guide rollers 49 and 51. The label guide rollers 59 have lip portions at their upper and lower ends much like those of sewing thread spools. The distance between these lip portions is less than the width of the labels themselves and are equally spaced from the centerline of the belt 47. The label guide rollers 59 are of a material which does not adhere to or pick-up the adhesive on the back sides of the labels. A satisfactory material for this purpose is a fluorocarbon resin, for example, commercially available and sold as "teflon" which is a registered trademark of the manufacturer, E. I. Dupont de Nemours and Co., Wilmington, Del.

Coaxial with and fixedly mounted on the same shaft as the belt guide roller 53 is a pulley wheel 53' adapted to be driven bythe belts 63, 63' and 63'' and the drive roller 65 which is one of a plurality of rollers which are driven by the pulley belt 67 as this belt drives the conveyor belt system 11 (not shown in FIG. 4). This is but one of several options available for driving the label transport belt 47 which could be driven by a separate electric motor, for example, provided for that purpose.

As shown the label transport system 40 comprising the label guide rollers 59 and the belt guide rod 57 may be mounted on a separate base plate 69 secured to the plate member 43 by means of quick mounting bolts 71 and 73, for example. This arrangement also allows adjustment for traction on labels and easy assembly and dis-assembly of the label transport system 40 for servicing and maintenance. The base plate 69 may be of the same material as the label guide rollers 59 so as to minimize the likelihood of picking-up the adhesive on the labels or sticking thereto.

As explained previously, as a label is separated from its backing tape 27, it moves vertically and its upper end extends through the space between the label transport belt 47 and the first of the label guide rollers 59. It is then carried upwardly between the belt 47 and the label guide rollers 59 with the adhesive coated surface of the label facing and being in contact with the label guide rollers 59. As the label makes its exit from the label transport mechanism 40, its upper end contacts a final label guide roller 76 which is spaced from the series of guide rollers 59 and positioned so that the label is forced to one side (i.e., the left side as shown in FIG. 4) and is drawn onto and retained by the label applicator head assembly 75 by means of a partial vacuum established at the lateral surface 78 of the applicator head 85.

Referring now to FIGS. 6 through 9, the applicator head assembly 75 comprises an external cylindrical cup-like member 85 mounted on a shaft 86 and over a cylindrical core member 87. The cylindrical member 85 (hereinafter called the applicator head) is provided on its surface with oppositely positioned flat portions 76 and 78, the area of these flat surfaces being of a size and shape conforming to the size and shape of the labels. These flat portions 76 and 78 may be referred to as label receiving-ejecting grids since each portion is gridded or perforated and, in operation is alternately internally connected to sources of sub-atmospheric and super-atmospheric air pressures as the applicator head 85 rotates from a label-receiving position to a label-ejecting position. At the label-receiving position a region of sub-atmospheric air pressure is established internally within and on one side of the applicator head 85 and is operative through the perforations in the grid surface (i.e., at portion 78) to receive and retain labels thereat. Upon 180° rotation of the applicator head 85, this grid portion (i.e., 78) is connected to a source of super-atmospheric air pressure which is internally established within the applicator head 85 and which is now operative through the aforesaid perforations to blow the label from this grid portion onto a package or article which has moved on the conveyor belt system 11 immediately adjacent and above the applicator head 85. It will be understood that labels are received and retained on the applicator head 85 with the indicia-bearing surface of the label being in contact with the gridded portion of the applicator head 85 and the adhesive-coated side of the label facing outwardly for impingement onto the article.

Upon 180° rotation of the applicator head 85 the opposite gridded portion 76 moves from the label-ejecting position to the label-receiving and retaining position so that the next label may be immediately supplied thereto. The applicator head 85 is caused to rotate by means of a drive motor 77 and pulley belt 79 with the belt 79 being in contact with the applicator head 85. The applicator head 85 is normally prevented from rotation by means of a ratchet-pawl combination 91, 81. The ratchet 91 is a cylindrical plate fixedly mounted on a shaft 95 which may be an integral hollow tubular extension on the end of the applicator head 85. The ratchet 91 is provided with two detents 91', 91''. The pawl 81 rides against the ratchet 91 and prevents rotation of the applicator head by having its tip alternately engaging oppositely disposed detents 91', 91'' in the ratchet 91. The pawl 81 is adapted to be partially rotated and momentarily swung out of engagement with the ratchet 91 by means of an electrical solenoid 83 as is well known in the art. The pawl 81 is momentarily withdrawn from and returned to engagement with the ratchet 91. Upon withdrawal of the pawl 81, it clears one of the detents (i.e., detent 91') so that the applicator head drive belt 79 and motor 77 are effective to cause the applicator head 85 to rotate until the second detent (i.e., 91'') on the ratchet 91 comes into contact with the tip of the pawl 81 which again prevents further rotation of the applicator head 85. It will be understood that the solenoid 83 includes a spring-loaded shaft 82 pivotally secured to the pawl 81. Upon momentary application of current to the solenoid coils, the shaft 82 is drawn into the solenoid against spring resistance. Movement of the shaft 82 causes the pawl 81 to rotate slightly and out of contact with the ratchet 91. Upon cessation of the current application to the coils of the solenoid 83, the solenoid springs (not shown) immediately return the pawl 81 to its position of contact with the ratchet 91.

Referring now to FIGS. 6 through 10, the applicator assembly 75 includes, in addition to the applicator head member 85, a relatively solid core member 87, the ratchet 91 and a belt-driven pulley 93. As described herein before, the ratchet plate 91 is mounted on the end portion of the applicator head 85 and around the integral shaft extension 95 thereof. Mounted on top of the ratchet 91 is the pulley wheel 93 which is likewise mounted around the shaft portion 95 of the applicator head 85. The entire applicator assembly 75 is affixed to the base plate member 43 by means of a shaft or bolt 97 which extends through the hollow shaft 85 of the member 85 and is threaded into the base 43. Rotatable members comprising the applicator head 85, the ratchet 91, and the pulley 93 are rotatably retained in position around the shaft portion 95 by means of a nut 97' while the core member 87 is fixedly mounted against the base plate 43 so that it does not rotate.

Figure 7:
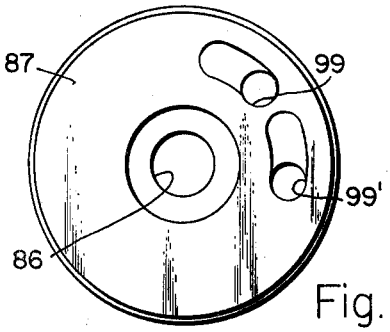
FIG. 7 is a bottom view of the core member of the applicator assembly shown in FIG. 6.
Figure 8:
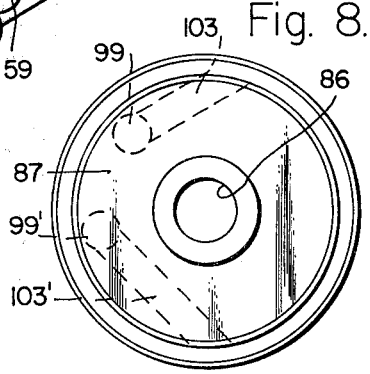
FIG. 8 is a plan view of the core member of the applicator assembly shown in FIG. 6.
Figure 5:
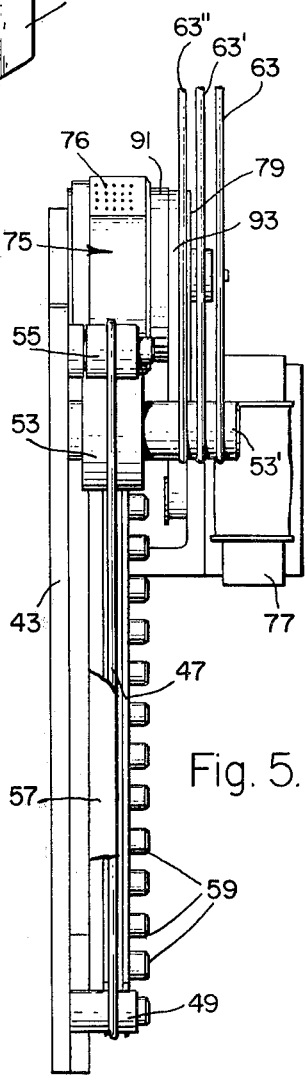
FIG. 5 is a left side view of the apparatus shown in FIG. 4.
Figure 10:
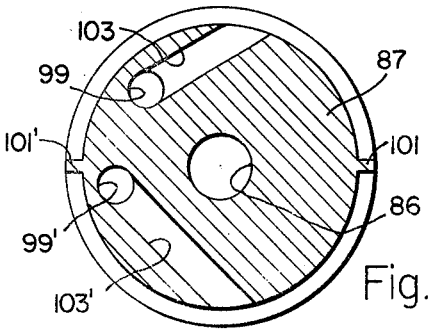
FIG. 10 is a sectional view of the core member shown in FIG. 9 taken along the line $x$—$y$ thereof.
Figure 9:
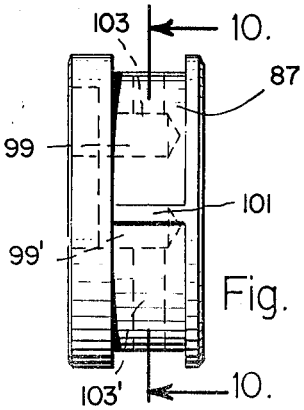
FIG. 9 is a side view of the core member of the applicator assembly shown in FIG. 6.

The core member 87 is provided with a pair of ports 99 and 99' in the bottom thereof as shown in FIGS. 7 and 10. Each of the ports 99 and 99' is disposed over and in airtight communication with the conduits 96 and 96' (see FIG. 1) which are connected to a motor-driven air compressor or pump 107 which is mounted on the base shelf 3. The air compressor or pump 107 is of the type which is capable of establishing air under pressure greater than atmospheric as well as air at a pressure less than atmospheric. Hence, the air pressure at port 99 in the core member 87 is less than atmospheric while the air pressure at port 99' is greater than atmospheric.

The core member 87 is also supplied with two external channels 89 and 89' which extend circumferentially around its lateral side. These channels 89 and 89' are hermetically separated from communicating with each other by integral extensions 101 and 101' extending radially from the core member 87. When the rotatable cup member 85 is in place around the core member 87, the internal surface of the cup member 85 is substantially in hermetic contact with the radial extensions 101 and 101'. The channels 89 and 89' each communicate to whatever grid portion (76 or 78) of the applicator head 85 which is disposed thereover. Ports 99 and 99' in the bottom of the core member 87 communicate respectively to channels 89 and 89' by means of the internal channels 103, 103' provided in the core member 87. Thus, the channels 89 and 89' are always maintained at different air pressures, one being greater than atmospheric and one being less than atmospheric. One channel may thus be spoken of as the low pressure channel and the other channel may be referred to as the high pressure channel. When the grid portions 76 and 78 of the applicator head 85 are over these channels 89 and 89', the air pressure at the grid portion will be that of the channel beneath it and to which that grid portion communicates by and through the perforations therein. As the applicator head 85 rotates as described hereinbefore, each grid portion (76 and 78) thereof alternately communicates with the channels 89 and 89' so that the requisite air pressure condition may be established at the grid portions 76 and 78 depending upon whether that portion is in the label receiving-retaining position or in the label-ejecting position.

In operation, articles or packages are placed on the conveyor belt 17 and the operator selects the indicia desired for the first package by means of the console keyboard 13. When the package arrives at the photoelectric sensor 103 it interrupts a light beam which produces a signal which actuates the printing mechanism as described hereinbefore. The label for that package is printed, separated from the backing strip 27, and transferred by the label transport mechanism 40 to the label retaining surface 78 on the applicator 75. The package continues along the path of travel of the conveyor belt, its arrival at the photo-electric sensor 105 again interrupts a light beam which results in the production of an electrical pulse which is applied to the coils of the solenoid 83 so as to draw the shaft 82 down therein thus swinging the pawl 81 out of contact with the applicator 75. This permits the applicator head to rotate 180° or until the pawl 81 stops rotation thereof by contacting and abutting the succeeding detent on the ratchet 91. Actuation of the solenoid 83 is appropriately timed to permit applicator head 75 to rotate and present the label on the label retaining portion 78 in proper position as the package travels over an opening 21 in the package transport system 11. At this position of the applicator head, the label is blown onto the package.

There, thus, has been described a novel system for rapidly printing labels with any desired information thereon and applying these labels to the appropriate package or article.

What is claimed is:

1. Apparatus for printing and applying labels to articles, said labels having adhesive coated side and an indicia receiving side, said apparatus comprising:

(A) Conveyor means for transporting said articles along a predetermined path;

(B) Printing means for selectively printing any desired indicia on the indicia receiving side of individual labels;

(C) Label applicator means having a label receiving surface;

(D) And means for moving said labels from said printing means to said label receiving surface of said applicator means comprising:

(1) A plurality of label guide rollers disposed between said printing means and said applicator means, said label guide rollers being adapted to contact said adhesive-coated side of said labels;

(2) And a movable belt adjacent said plurality of label guide rollers and co-extensive therewith, said belt being adapted to contact the indicia receiving side of said labels.

2. The invention according to claim 1 wherein said label guide rollers are of a material which does not adhere to the adhesive material on said labels.

3. The invention according to claim 1 including sensing means responsive to the arrival of an article on said conveyor means at a predetermined point along said predetermined path to cause said label applicator means to apply a label to said article.

4. The invention according to claim 1 including sensing means responsive to the arrival of an article on said conveyor means at a predetermined point along said predetermined path to actuate said printing means and print pre-selected indicia on one of said labels.

5. The invention according to claim 1 including first and second sensing means disposed along said conveyor means, said first sensing means being responsive to the arrival of an article on said conveyor means at a first predetermind point along said predetermined path to actuate said printing means and print pre-selected indicia on one of said labels, said second sensing means being responsive to the arrival of said article on said conveyor means at a second predetermined point along said predetermined path to cause said label applicator means to apply said label to said article.

6. Apparatus for printing and applying labels to articles, said labels having adhesive coated side and an indicia receiving side, said apparatus comprising:

(A) Conveyor means for transporting said articles along a predetermined path;

(B) Printing means for selectively printing any desired indicia on the indicia receiving side of individual labels;

(C) Means for moving said labels from said printing means to label applicator means for applying said labels to said articles;

(D) Said applicator means comprising a rotatable member having:

(1) Means including a label receiving surface, for establishing a region of sub-atmospheric pressure at a first position thereof whereby said labels are received from said label moving means;

(2) And means for establishing a region of super-atmospheric pressure at said label receiving surface upon rotation of said rotatable member to a second position whereby said labels are blown from said receiving surface onto said articles;

(E) Said means for moving said labels from said printing means to said label applicator means comprising:

(1) A plurality of label guide rollers disposed between said printing means and said applicator means, said label guide rollers being adapted to contact said adhesive-coated side of said labels;

(2) And a movable belt adjacent said plurality of label guide rollers and co-extensive therewith, said belt being adapted to contact the indicia receiving side of said labels.

* * * * *